United States Patent [19]

Snyder

[11] Patent Number: 4,761,982

[45] Date of Patent: Aug. 9, 1988

[54] METHOD AND APPARATUS FOR FORMING A HEAT EXCHANGER TURBULATOR AND TUBE

[75] Inventor: George K. Snyder, Lockport, N.Y.

[73] Assignee: General Motors Corporation, Detroit, Mich.

[21] Appl. No.: 913,973

[22] Filed: Oct. 1, 1986

[51] Int. Cl.[4] ..... B21D 39/20

[52] U.S. Cl. ..... 72/58; 72/61; 72/323; 72/370; 264/573

[58] Field of Search ..... 72/57, 58, 60, 61, 306, 72/322, 323, 367, 370; 264/573

[56] References Cited

U.S. PATENT DOCUMENTS

| | | | |
|---|---|---|---|
| 2,465,677 | 3/1949 | Deverall | 72/58 |
| 3,394,569 | 7/1968 | Smith | 72/57 |
| 4,317,348 | 3/1982 | Halene et al. | 72/58 |

FOREIGN PATENT DOCUMENTS

| | | | |
|---|---|---|---|
| 1002423 | 2/1957 | Fed. Rep. of Germany | 72/61 |
| 59-229236 | 12/1984 | Japan | 72/58 |
| 60-82229 | 5/1985 | Japan | 72/58 |
| 653006 | 3/1979 | U.S.S.R. | 72/61 |

*Primary Examiner*—W. Donald Bray
*Attorney, Agent, or Firm*—R. L. Phillips

[57] ABSTRACT

Method and apparatus therefor for forming an inner tube and turbulator for a concentric tube heat exchanger from a stock length of tube comprising the steps of simultaneously mechanically forming a bell-shaped sealing and outer tube attaching section in the ends of the tube while also sealing the ends, applying hydraulic pressure to the interior of the tube to form outwardly projecting turbulator bumps in the tube at places located about and along the length thereof, and increasing the mechanical forming force with increasing hydraforming force so that the latter opposes the former and only their net force acts on the bell-shaped sections to maintain the sealing during the hydraforming to prevent coining of these sections.

4 Claims, 2 Drawing Sheets

METHOD AND APPARATUS FOR FORMING A HEAT EXCHANGER TURBULATOR AND TUBE

TECHNICAL FIELD

This invention relates to method and apparatus for forming heat exchanger turbulators and tubes and more particularly to using both mechanical and hydraulic forming forces to form both the turbulator and inner tube for a concentric tube heat exchanger.

BACKGROUND OF THE INVENTION

In the manufacture of concentric tube heat exchangers, such as those employed as motor vehicle automatic transmission oil coolers, it is common practice to insert a turbulator between the inner and outer tube for the purpose of improving heat transfer efficiency. Typically, the turbulator is formed from flat sheet with a die so as to have spaced bumps or projections. The sheet with bumps is then rolled into a sleeve shape for insertion between the tubes whose ends are then sealingly joined. This construction provides efficient heat transfer and long product life but the turbulator part is difficult to handle automatically. Moreover, the material cost of the separate turbulator part is a substantial part of the overall cost of the cooler. It has been proposed to construct one of the tubes from flat sheet by forming the turbulator bumps therein and then rolling and seam welding same. However, the seam weld presents both production and quality problems.

SUMMARY OF THE INVENTION

The present invention is in method and apparatus for simultaneously mechanically and hydraulically forming a turbulator from a straight plain stock piece of tube such that it is suited for sealed installation without further forming as both a turbulator and inner tube in the outer tube that of a concentric tube heat exchanger assembly. Provision for both sealing of the ends of the stock tube piece during hydraulic forming from within of outwardly projecting turbulation bumps and the sealing of these inner tube ends to the outer tube at assembly is by the formation of annular radially outwardly displaced bell-shaped sealing sections in the ends of the tube piece using simultaneously operated punches that are forced into the tube ends with the tube installed in a hydraform die that additionally has punch dies against which the sealing sections are pressed by the punches. The forming and initial sealing of the ends of the tube piece is effected with the punches with a relatively low force and the tube piece is then filled with hydraulic fluid that is then pressurized to form the turbulation bumps. As the latter takes place, the punch force is then increased in proportion to the hydraulic forming pressure to maintain the necessary high pressure sealing. With the hydraulic force opposing the punch forces, it is only their net force that acts on the tube's pieces sealing sections to maintain sealing contact between the latter and the punch dies rather than the full punch force which otherwise might coin these sections. Moreover, the metal-to metal sealing that is provided is ideally suited to handling the high hydraforming pressures involved(e.g. abut 14,000 psi with 0.050 inch thick brass). In comparison, conventional methods of sealing such as o-rings would not normally be maintainable on a production basis at such high pressure. And it will also be appreciated that in addition to integrally forming the turbulator and inner tube as one part, the processing of same including the formation of the metal-to-metal sealing for the hydraforming of the turbulation bumps readily lends itself to automation.

DESCRIPTION OF PREFERRED EMBODIMENT

These and other objects, advantages and features of the present invention will become more apparent from the following description and drawing in which.

Figure 1:
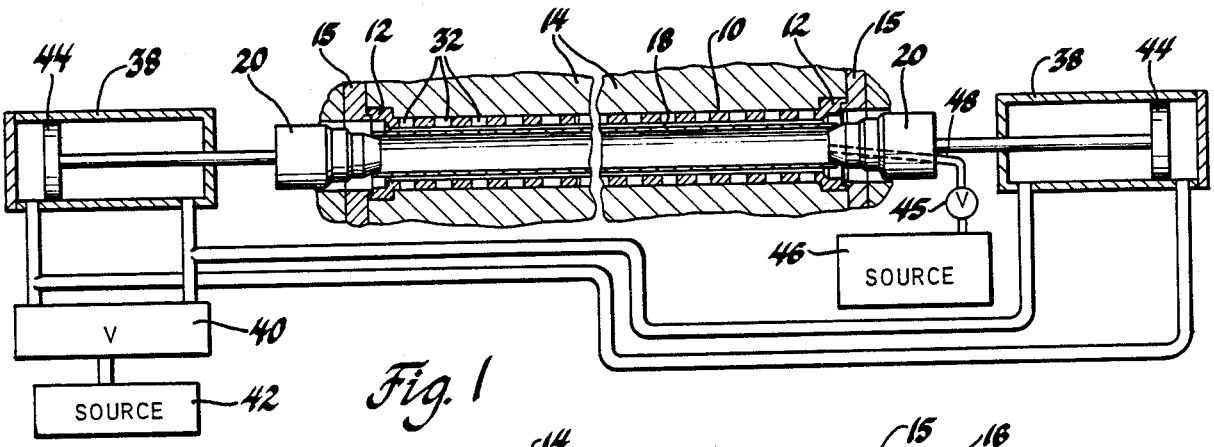
FIG. 1 is a schematic view of the preferred form of apparatus according to the present invention with a stock piece of tube inserted therein for processing.
Figure 2:
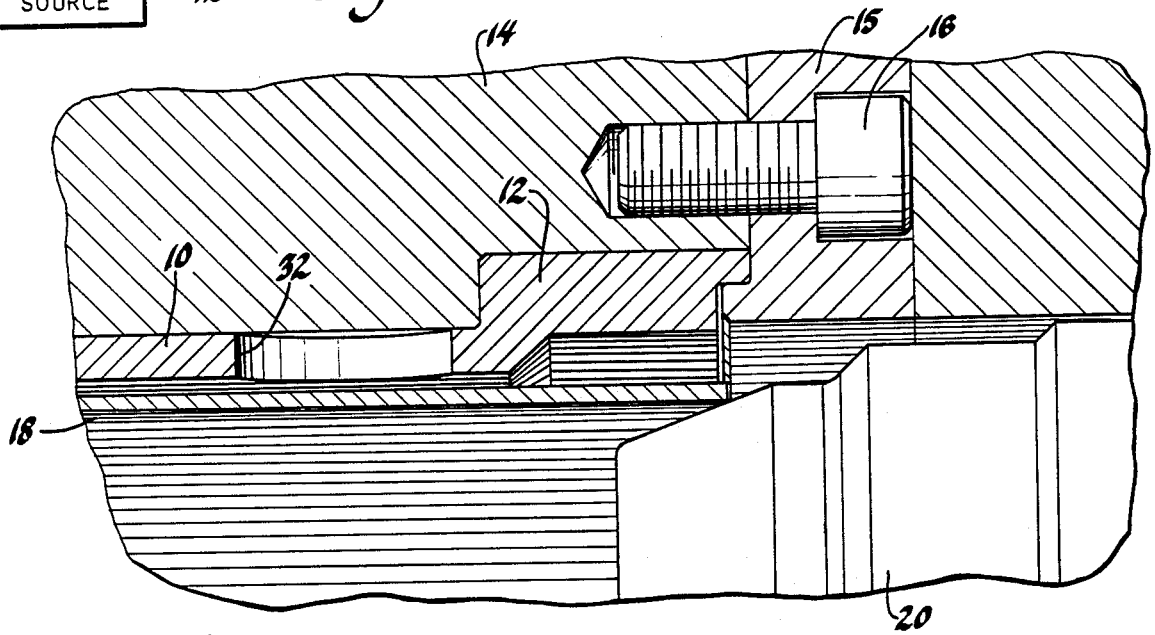
FIG. 2 is an enlarged sectional view of the right-hand end of the hydraforming die and the right-hand punch die arrangement in FIG. 1.

Referring to the drawings wherein the same numbers are used throughout the several views to identify the same parts, there is shown in FIGS. 1–4 a hydraforming die 10 of cylindrical shape with a punch die 12 formed on each end thereof and such integral three dies clamped to a surrounding housing 14 by annular plates 15 and angularly spaced bolts 16. The dies 10 and 12 are adapted to receive a stock piece 18 of round tube of predetermined length with the ends of the stock tube piece located at the respective punch dies and the stock piece extending along the length of the hydraforming die as shown in FIGS. 1 and 2. With the stock tube piece thus inserted in the dies, identical hydraulically operated punches 20 are positioned opposite the respective punch dies.

Figure 3:
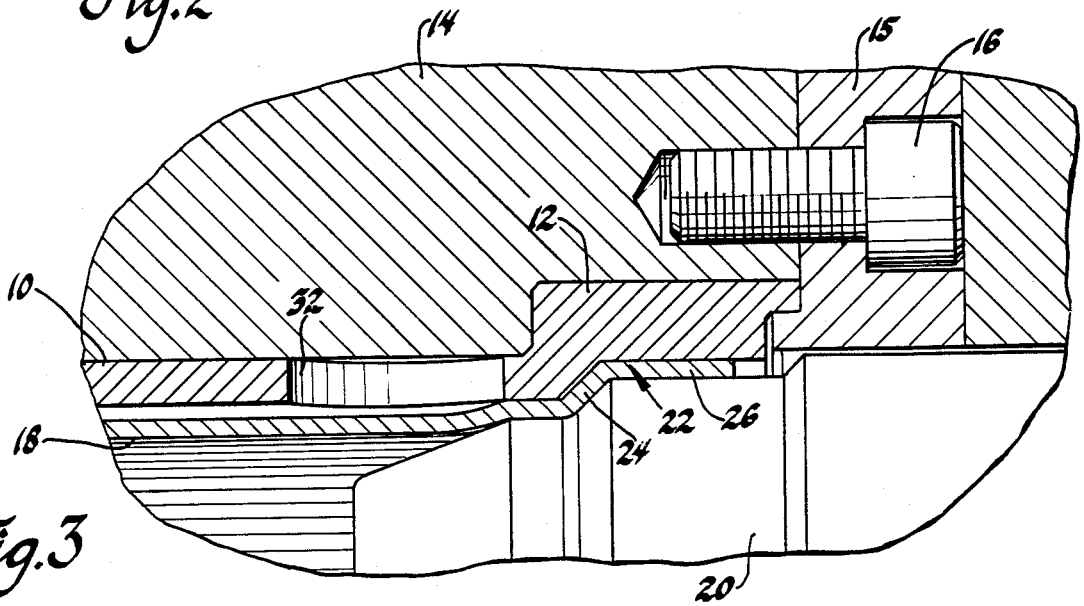
FIG. 3 is a view similar to FIG. 2 but following the punch die operation.
Figure 4:
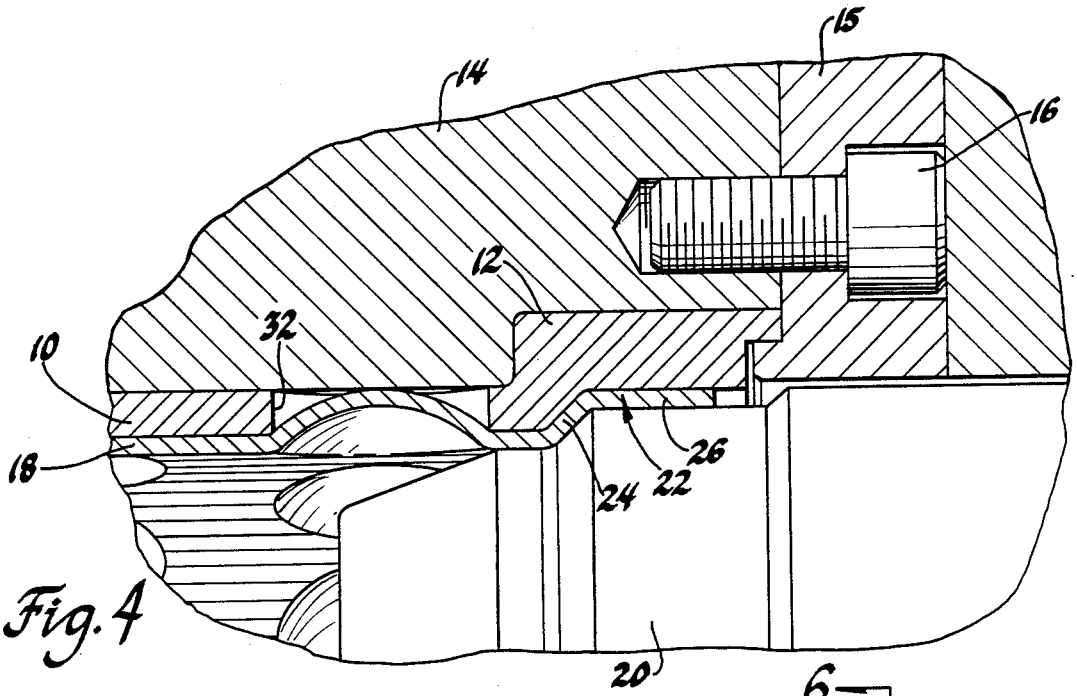
FIG. 4 is a view similar to FIG. 3 but following the hydraforming operation.
Figure 5:
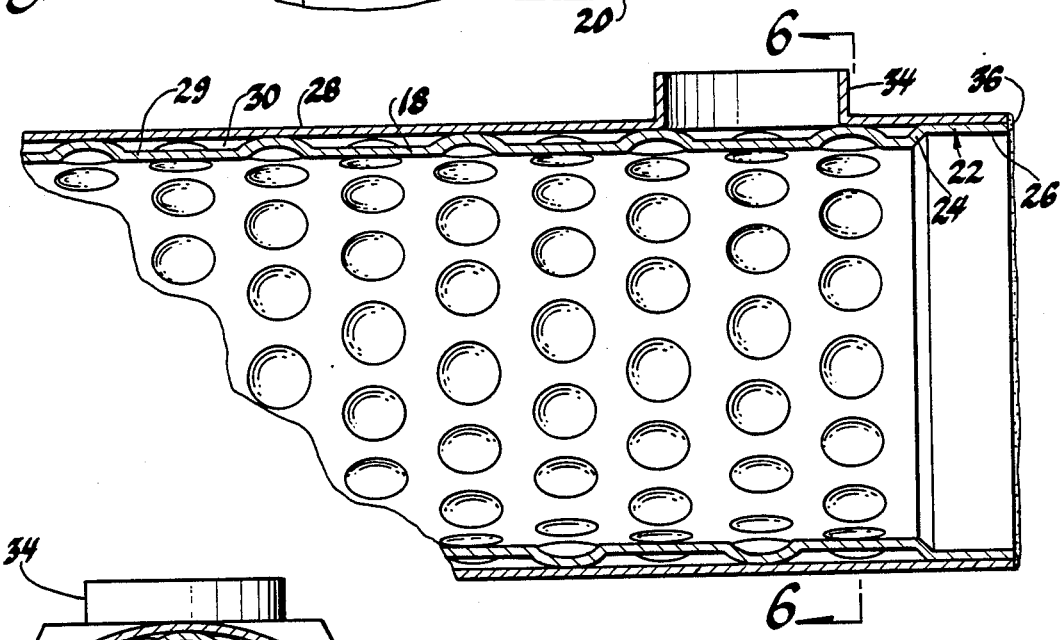
FIG. 5 is a longitudinal sectional view of one end of a concentric tube oil cooler constructed with the one-piece turbulator and inner tube formed with the apparatus in FIG. 1.

The punches and their respective dies are configured so as to cooperatively form a radially outwardly displaced bell-shaped section 22 in the ends of the tube piece comprising an annular radially outwardly projecting conically shaped portion 24 adjacent the tube end and a round cylindrical portion 26 that terminates at the tube end (see FIGS. 3 and 4). The bell-shaped sections 22 at the ends of the tube provide for the tube to be inserted inside another tube 28 of larger diameter as shown in FIG. 5 with the cylindrical collar-shaped portions 26 of the inner tube slip fitting in the respective ends of the outer tube and terminating therewith and the intermediate portion 29 of the inner tube intermediate the collars spaced radially inward of the outer tube so as to define an annular closed space 30 between the tubes.

The hydraforming die 10 is configured with a plurality of round radial holes 32 so as to form outwardly projecting partial spheres or bumps spaced along and about the inner tube's intermediate portion 29. The bumps extend radially so as to span the closed space 30 and contact the interior of the outer tube to form an effective turbulator in the liquid flow between the tubes.

Figure 6:
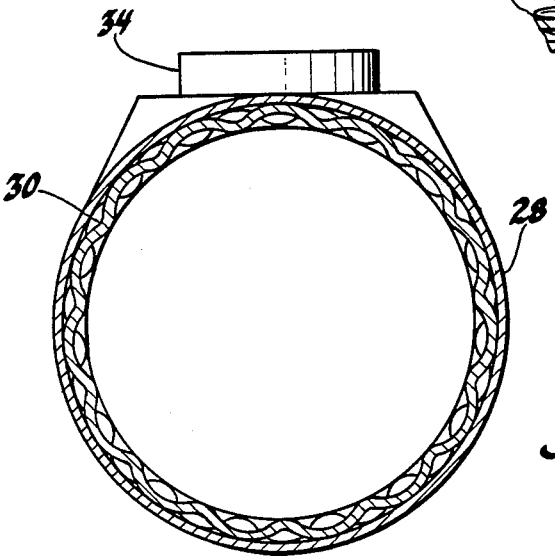
FIG. 6 is a view taken on the line 6—6 in FIG. 5.

The outer tube on the other hand is simply preformed with a radial flanged hole 34 at each end (only one being shown—see FIGS. 5 and 6) for communicating the heat transfer space 30 between the tubes with the liquid to be cooled. The oil cooler assembly is completed by a seam weld 36 that sealingly joins the end edges of the inner and outer tubes at each end (only one being shown—see FIG. 5).

Describing now both the formation of the bell sections and the turbulation bumps on the inner tube, the former which are utilized for spacing and end closure in the cooler assembly are also utilized to seal the ends of the tube for the hydraforming by mechanically forming and holding same during the hydraforming. With a stock piece inserted in the forming apparatus as shown in FIG. 1, the punches 20 are operated by identical hydraulic cylinders 38 through control of a valve 40 that controls communication of a source 42 of hydraulic fluid at a regulatable pressure with the opposite ends of the cylinders so that the punches are advanced by the respective pistons 44 with just sufficient force to form the bell sections in the ends of the tube as shown only at the right-hand end in FIG. 3. With the formation of the bell sections, the punches are not retracted and instead continue to bear against same so as to close and seal the ends of the tube piece while a valve 45 is then opened to communicate another source 46 of hydraulic fluid at a regulatable pressure with the thus sealed interior of the stock tube piece by a passage 48 extending through one of the punches as shown in FIG. 1. Upon filling of the sealed tube piece and as the fluid is then pressurized to bulge form the turbulation bumps against the hydraforming die, the pressure in the punch operating cylinders is then increased above the initial bell forming pressure and in proportion to the increasing hydraforming pressure so as to maintain the end sealing whose force requirements increase in proportion thereto. As a result, the hydraforming force opposes the punch forces so that only their difference or net force acts on the bell sections rather than the full punch force required which might otherwise coin these sections.

The above described embodiment is illustrative of the invention which may be modified within the scope of the appended claims.

The embodiments of the invention in which an exclusive property or privilege is claimed are defined as follows:

1. A method of forming an integral inner tube and turbulator for a concentric tube heat exchanger from a stock length of tube comprising the steps of simultaneously forming a sealing and outer tube attaching section in both ends of the tube while also sealing the ends thereby, applying hydraulic pressure to the interior of the tube to hydraform outwardly projecting turbulation bumps in the tube at places located about and along the length thereof, and increasing the section forming force with increasing hydraforming pressure so that the hydraforming force opposes the section forming forces and only their net force acts on said sections to maintain said sealing during said hydraforming to prevent coining and thereby weakening of said sections.

2. A method of forming an integral inner tube and turbulator for a concentric tube heat exchanger from a stock length of tube comprising the steps of simultaneously mechanically punch die forming an annular radially outwardly displaced sealing and outer tube attaching section in both ends of the tube while also sealing the ends thereby, applying hydraulic pressure to the interior of the tube to hydraform outwardly projecting turbulation bumps in the tube at places located about and along the length thereof, and increasing the mechanical forming force in proportion to the hydraforming force so that the hydraforming force opposes the mechanical forming forces and only their net force acts on said sections to maintain said sealing during said hydraforming to prevent coining and thereby weakening of said sections.

3. Apparatus for forming an integral tube and turbulator for a heat exchanger from a stock piece of tube comprising a cylindrical hydraforming die having bulge forming holes therein, a punch die fixed to each end of the hydraforming die, said dies adapted to receive the stock piece, a punch for cooperating with each punch die to form a sealing and tube attaching section in each end of the stock piece and also sealingly close same, control means for controlling the force of said punches so that the punch force is sufficient to form said bell-shaped sections and thereafter may be increased, a source of hydraulic fluid at a regulatable pressure, means for communicating said hydraulic fluid with the interior of the stock piece while sealed by said punches at said sections such that the hydraulic fluid fills said interior and then increases in pressure to form outwardly projecting bumps in the stock piece, and said control means also providing for increasing the force of said punches with increasing hydraulic pressure in the stock piece to maintain said sealing and also so that the increasing hydraulic force opposes the increasing punch forces such that only their net force acts on said sections to prevent coining and thereby weakening thereof by said punches.

4. Apparatus for forming an integral tube and turbulator for a heat exchanger from a stock piece of tube comprising a cylindrical hydraforming die having bulge forming holes therein, a punch die fixed to each end of the hydraforming die, said dies adapted to receive the stock piece, a punch for cooperating with each punch die to form a bell-shaped section in each end of the stock piece and also sealingly close same, control means for controlling the force on said punches so that initially the punch force is just sufficient to form said bell-shaped sections, a source of hydraulic fluid at a regulatable pressure, means for communicating said hydraulic fluid with the interior of the stock piece while sealed by said punches at said section such that the hydraulic fluid fills said interior and then increases in pressure to form outwardly projecting bumps in the stock piece, and said control means also providing for increasing the force of said punches in proportion to the increasing pressure in the stock piece to maintain said sealing and also so that the increasing hydraulic force opposes the increasing punch forces such that only their net force acts on the bell-shaped sections to prevent coining and thereby weakening thereof by the punches.

* * * * *